United States Patent [19]

Pohl et al.

[11] Patent Number: 4,769,962

[45] Date of Patent: Sep. 13, 1988

[54] CONTROLLED ENVIRONMENT ENCLOSURE

[75] Inventors: Ronald R. Pohl, Rochester; Raymond Mach, Mt. Clemens, both of Mich.

[73] Assignee: Venderbush Industrial Corporation, Mt. Clemens, Mich.

[21] Appl. No.: 88,007

[22] Filed: Aug. 18, 1987

Related U.S. Application Data

[63] Continuation of Ser. No. 877,141, Jun. 23, 1986, abandoned.

[51] Int. Cl.[4] ..... E04H 15/34; E04B 1/00

[52] U.S. Cl. ..... 52/273; 52/63; 135/101

[58] Field of Search ..... 52/63, 273; 135/100, 135/101, 102, 900; 98/115.2

[56] References Cited

U.S. PATENT DOCUMENTS

| | | | |
|---|---|---|---|
| 2,757,677 | 8/1956 | Denn | 135/100 |
| 3,788,335 | 1/1974 | Hemmelsbach | 135/101 |
| 4,091,584 | 5/1978 | Brown | 135/102 |
| 4,121,604 | 10/1978 | Rain | 135/102 |
| 4,231,289 | 11/1980 | Domicent | 135/102 X |
| 4,274,234 | 6/1981 | Abell | 52/273 X |
| 4,347,690 | 9/1982 | Wallace | 135/101 X |
| 4,381,629 | 5/1983 | Ahn | 135/101 X |
| 4,404,980 | 9/1983 | Wade | 135/102 |

*Primary Examiner*—J. Karl Bell

*Attorney, Agent, or Firm*—Basile and Hanlon

[57] ABSTRACT

A controlled environment enclosure provides a dust-free atmosphere for manufacturing operations. The enclosure includes a frame formed of interconnected, horizontally and vertically extending, spaced frame members. An outer cover member is deployed over the sides and top of the interconnected frame members. The outer cover member is formed of a heat shrinkable material which provides a taut, secure attachment of the cover member to the frame members. The bottom ends of the cover member are sealingly attached to a lower support surface or floor by means of an interconnectable clamp and strip having a mating projection and notch which traps the bottom end of the cover member therebetween.

1 Claim, 2 Drawing Sheets

CONTROLLED ENVIRONMENT ENCLOSURE

This application is a continuation of application Ser. No. 877,141, filed June 23, 1986, now abandoned.

BACKGROUND OF THE INVENTION

1. Field of the Invention

The present invention relates in general to clean environment enclosures typically employed in paint operations in manufacturing plants.

2. Description of the Prior Art

In manufacturing facilities where products are being painted, it is necessary that the immediate area surrounding the paint operation be as clean as possible and free from dust and dirt in order to provide the best application of paint to the product.

This has usually resulted in the construction of an enclosure surrounding the paint operation. Such so-called clean environment enclosures are typically provided with positive air flow into the enclosure to thereby prevent dust and dirt from entering the open ends of the enclosure through which the parts travel. Such enclosures have also been built of rigid side and top panels with opposed open ends. While effective, such enclosures are relatively expensive, require lengthy installation time and could be costly to repair if a break occurs in one of the rigid panels.

Thus, it would be desirable to provide a controlled environment enclosure which can be easily constructed, have its dimensions easily altered as necessary for different applications, provides a clean, dust-free environment and can be quickly and easily repaired if necessary.

SUMMARY OF THE INVENTION

The present invention is a controlled environment enclosure which provides a clean, dust-free atmosphere ideally suited for paint operations in manufacturing plants. The enclosure includes a frame formed of a plurality of interconnected horizontal and vertically extending, spaced frame members. Preferably the frame members are formed of tubular conduits. Connectors are provided for interconnecting the ends of the frame members to form the frame members into a rigid, open frame.

A cover member is deployed over the sides and top surfaces of the frame leaving opposed open ends in the frame. The cover member is formed of a heat shrinkable material which, when heat is applied thereto, shrinks to a taut form and binds itself tightly to the frame members.

Sealing means are mounted along the bottom side edges of the frame for sealing the bottom edges of the cover member to the floor or other support surface. In a preferred embodiment, the sealing means is in the form of an elongated strip having an upwardly extending projection. A complimentary shaped clamp is provided for tightly mounting over the projection on the strip. The clamp traps the bottom edge of the cover member between itself and the projection thereby sealingly attaching the bottom edge of the cover to the frame. Positive air pressure may be input to the enclosure to thereby prevent the entry of dust into the interior of the enclosure through the open end walls.

Optionally, the cover member is formed of at least a semi-transparent material to allow visibility into the enclosure. A door can also be sealingly attached to one of the side walls of the cover member to allow access into the interior of the enclosure at an intermediate portion of its length.

The controlled environment enclosure of the present invention provides an enclosure which is aesthetically pleasing, has clean lines and is inexpensive to manufacture. The enclosure also provides positive dust stoppage, is easily repairable and its dimensions can be easily changed as necessary to fit any application.

BRIEF DESCRIPTION OF THE DRAWING

The various features, advantages and other uses of the present invention will become more apparent by referring to the following detailed description and drawing in which.

DESCRIPTION OF THE PREFERRED EMBODIMENTS

Figure 1:
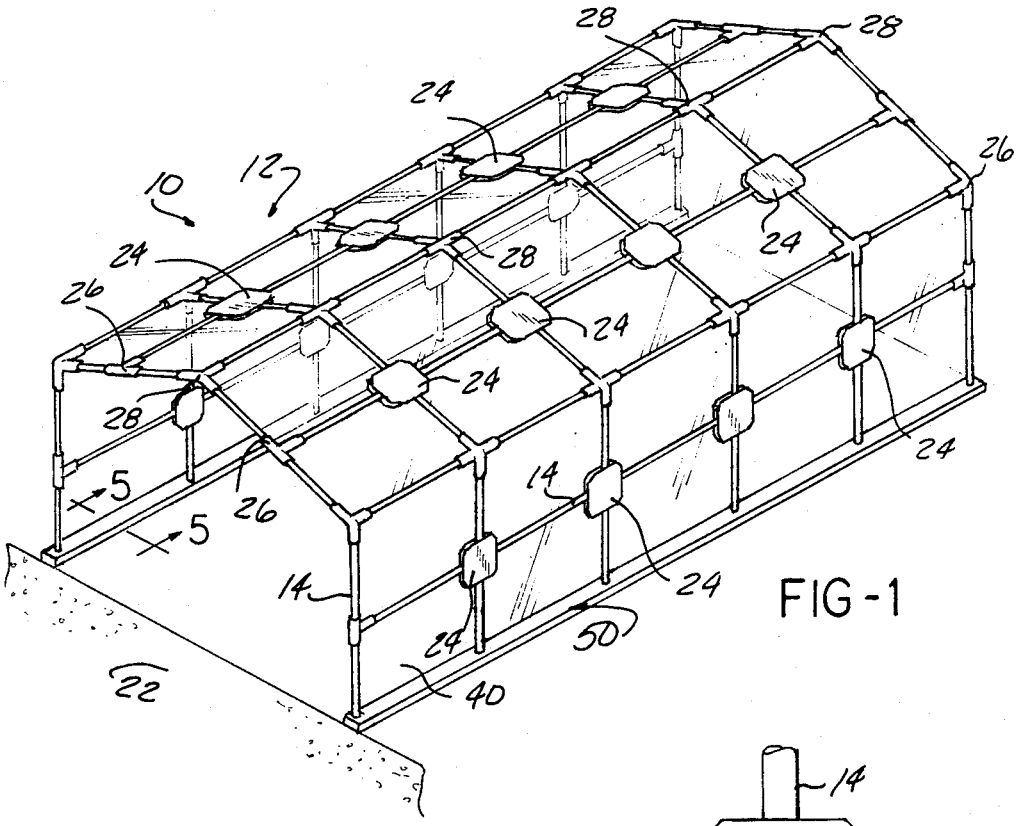
FIG. 1 is a perspective view of the controlled environment enclosure of the present invention.

Throughout the following description and drawing, an identical reference number is used to refer to the same component shown in multiple figures in the drawing.

In general, the present invention is a controlled environment enclosure 10 which provides a dust-free environment ideally suited for use in paint operations in a manufacturing plant. As shown in FIG. 1, the controlled environment enclosure 10 includes a frame denoted in general by reference number 12. The frame 12 is constructed of a plurality of vertically and horizontally extending frame members 14. Preferably, the frame members 14 are formed of tubular, hollow conduits which are spaced apart to form vertically extending sides, a roof and opposed open ends.

Figure 5:
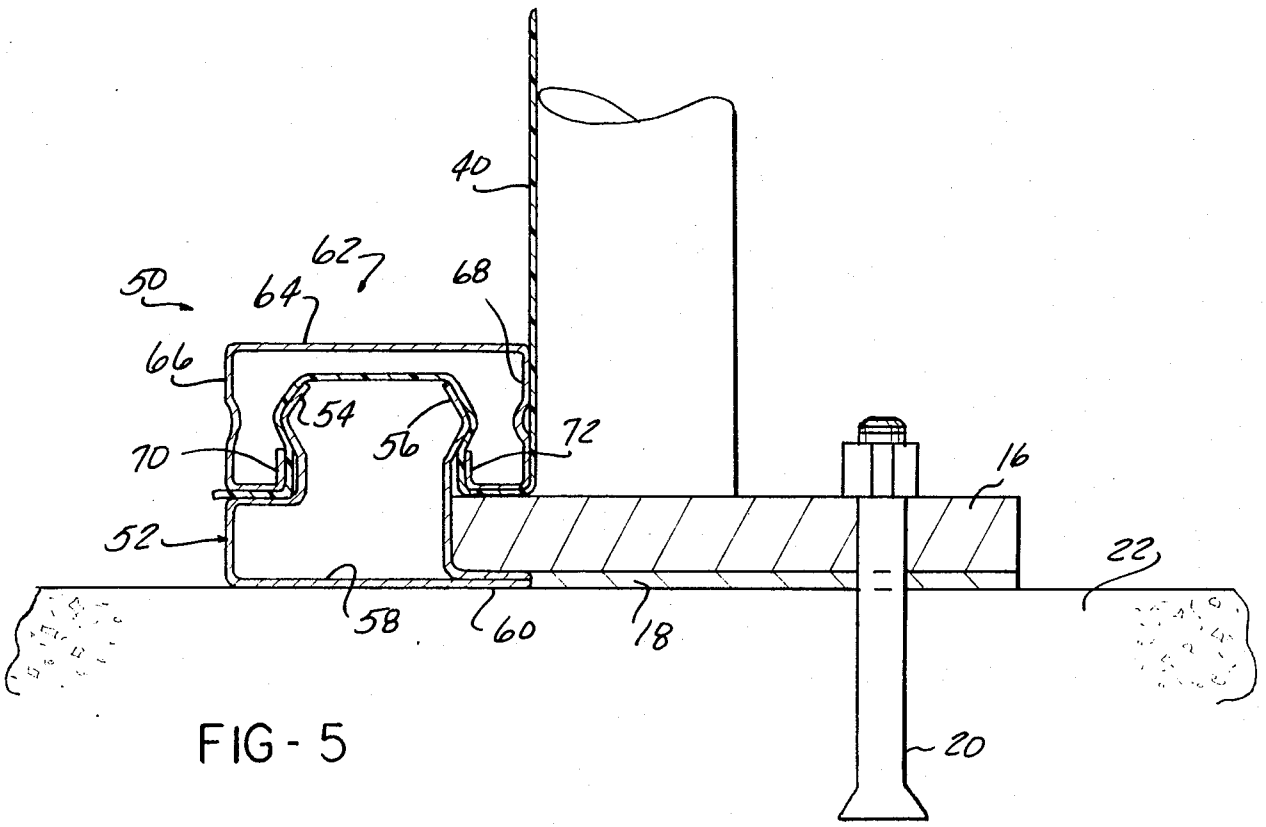
FIG. 5 is a cross-sectional view generally taken along line 5—5 in FIG. 1.

Referring briefly to FIGS. 1 and 5, the bottom ends of the vertically extending frame members 14 are fastened, such as by welding, to an elongated base plate 16. A shim 18 is disposed below the base 16 for reasons which will become more apparent hereafter. Expansion anchors 20 are employed at spaced locations along the length of the base plate 16 for securing the base plate 16 and shim 18 to the underlying support surface or floor 22 of the manufacturing plant.

Figure 2:
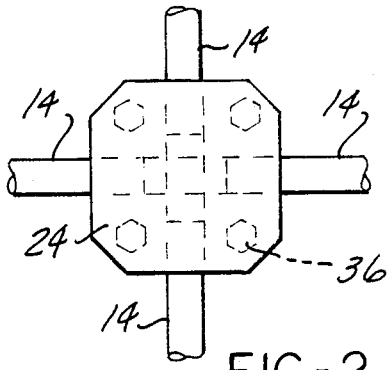
FIGS. 2 and 3 and 4 are plan and perspective views, respectively, of the connectors employed to interconnect the ends of the frame members into a rigid frame.
Figure 3:
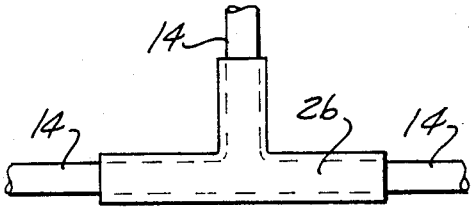
Figure 4:
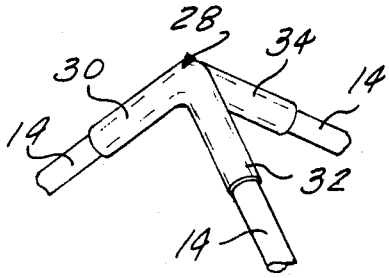

A plurality of connectors are employed for interconnecting the ends of the horizontal and vertically extending frame members 14 into the rigid frame shape illustrated by way of example in FIG. 1. By way of example only, the connectors include a plurality of four-way connectors 24 as shown in FIG. 2, a number of three-way connectors 26 as shown in FIG. 3 which have a planar form, and a plurality of three-way connectors 28 in which the legs 30, 32 and 34 are angularly disposed with respect to each other as shown in detail in FIG. 4. Each of the connectors 24, 26 and 28 is provided with internal bores which receive the ends of the conduits 14. Suitable means, such as the fasteners employed in the four-way connector 24 in FIG. 2 or weld may be employed to securely fasten the ends of the frame members 14 to each of the connectors 24, 26 and 28. By way of example, the connectors 24, 26 and 28 may be "Framemaker" type clamps manufacturing by the Fulton Manufacturing Co.

The connectors 24, 26 and 28 enable the frame 10 to be easily and quickly constructed in any desired length and configuration. The number of horizontal and vertically extending frame members 14 may be varied depending upon the desired length, width or height of the frame 12.

As shown in FIGS. 1 and 5, an outer cover member 40 is deployed over the exterior surface of the interconnected frame members 14 leaving the opposed ends of the enclosure 10 open. The cover member 40 is formed of a heat shrinkable material which is at least partially transparent. Preferably, however, it is desired that the cover member 40 be formed of a completely transparent material. When heat is applied to the cover member 40 after it has been deployed over the frame 12, its properties cause it to shrink thereby tightly adhering the cover member 40 to the exterior surfaces of the frame members 14 and providing a taut outer surface.

Means denoted in general by reference number 50 are provided for sealingly attaching the bottom side ends of the cover member 40 to the lower support surface or base 16. As shown in detail in FIG. 5, the sealing means 50, by way of example only, includes an elongated strip 52 having a pair of legs 54 and 56 which extend upward from a lower base portion 58 to form an upwardly extending projection. The strip 52 is provided with a flange portion 60 along one side edge which is securable underneath the base 16 to attach the strip 52 securely in place on the support surface 22. By way of example, the elongated strip 52 may be a strip sold by the Unistrut Corporation, Model No. P4000.

A complimentary-formed clamp 62 is provided for snap-on attachment over the projection on the strip 52. The clamp 62 is formed with an upper surface 64 and two depending side walls 66 and 68 which terminate in upwardly extending flanges 70 and 72, respectively. The flanges 70 and 72 are configured to snap over the bent portion of the legs 54 and 56 of the strip 52 to securely attach the clamp 62 to the strip 52.

As shown in FIG. 5, prior to the installation of the clamp 62, the bottom end of the cover member 40 is deployed above the projection formed by the angularly bent legs 54 and 56 in the strip 52. Once the clamp 62 is snapped over the strip 52, the bottom edge of the cover member 40 is securely and sealingly attached to the frame 12. By way of example, the clamp 62 may be a closure strip also sold by the Unistrut Corporation under Model No. P4184-61.

Due to the tight fit caused by the shrinkage of the cover 40 over the exterior surface of the frame members 14 and the sealing attachment of the bottom ends of the cover member 40 to the lower supporting surface or plant floor 22, a sealed, controlled environment enclosure is formed for ideal us in manufacturing paint operations.

Although not shown in the drawing, the controlled environment enclosure 10 may be provided with an input source of pressurized air. This provides a positive outflow of air from the interior of the enclosure 10 through the open ends thereby preventing the ingress of dust or dirt into the interior of the enclosure 10. Also, a door, not shown, which is sealingly closable may be mounted in a portion of one of the sides of the cover member 40 to allow ingress through the side of the frame 10 into the interior of the enclosure 10.

In summary, there has been disclosed a unique controlled environment enclosure which provides a dust-free environment ideally suited for use in manufacturing plant paint operations. The enclosure is inexpensive to manufacture and provides an aesthetically pleasing look with clean structure lines. The controlled environment enclosure of this invention also may be formed with any desired dimensions depending upon the particular application.

What is claimed is:

1. In a controlled environment enclosure including a frame mountable on a support surface, said frame formed with a plurality of interconnected, spaced horizontally and vertically extending frame members, and means for connecting adjacent ends of the horizontally and vertically extending frame member into a rigid frame having opposed side walls, a top, and opposed open end walls, the improvement comprising the combination of:

an elongated base plate connected to bottom ends of the vertically extending frame members along the length of both sides of the enclosure;

an elongated strip having a flange portion extending beyond one side for securing the strip adjacent the base plate with the flange wedgingly secured beneath the base plate, said elongated strip further having a pair of legs extending upwardly from a lower base portion to define an upwardly extending projection;

a shim disposed between the base plate and said support surface along the length of the base plate on both sides of the enclosure and supporting a portion of the width of the base plate extending from the interior edge of the base plate and abutting the flange portion of the elongated strip;

a plurality of expansion anchors disposed at spaced locations along the length of the base plate on both sides of the enclosure, said plurality of expansion anchors securing the base plate and the shim to the support surface;

a cover member formed of a heat shrinkable material heatingly sealed to the exterior surface of the interconnected frame members;

an elongated strip mounted along the bottom edges of opposed side walls of the frame, the elongated strip having an upwardly extending projection; and a clamp complimentary formed to the shape of the projection and disposable thereover to sealingly attach the bottom ends of the cover member to the elongated strip between the clamp and the strip.

* * * * *